United States Patent [19]

Faraci, Jr.

[11] Patent Number: 4,940,241

[45] Date of Patent: Jul. 10, 1990

[54] THREE PLAYER CHESS-TYPE GAME

[76] Inventor: John A. Faraci, Jr., 2615 Shenandoah Ave., Durham, N.C. 27704

[21] Appl. No.: 413,338

[22] Filed: Sep. 27, 1989

[51] Int. Cl.[5] ..... A63F 3/02

[52] U.S. Cl. ..... 273/261; D21/24

[58] Field of Search ..... 273/260, 261, 258; D21/24

[56] References Cited

U.S. PATENT DOCUMENTS 3,533,627 10/1970 Deffenbaugh et al. ..... 273/261

4,653,759 3/1987 Anderson et al. ..... 273/261

FOREIGN PATENT DOCUMENTS 1597713 9/1981 United Kingdom ..... 273/261

*Primary Examiner*—Benjamin Layno

*Attorney, Agent, or Firm*—Olive & Olive

[57] ABSTRACT

A three player chess-like game comprising a game board including an equilateral triangle-shaped playing surface having an array of equilateral-triangle shaped playing spaces demarcated thereon, with home area playing surfaces at each side of the equilateral triangle-shaped playing surface, and a set of corresponding game pieces for each of three players. Each set of game pieces may include six pawns, two rooks, two bishops, one king, and one queen, each of which is governed as to its mobility in play by rules which are specific to the game board geometric configuration. A number of game variants are disclosed, including a "PAWNCHIZE" variation in which play is conducted with each player having twelve pawns, and governed by rules specific to the game board geometric configuration.

14 Claims, 2 Drawing Sheets

THREE PLAYER CHESS-TYPE GAME

BACKGROUND OF THE INVENTION

1. Field of The Invention

The present invention is directed to modifications and improvements relating to games played with moveable pieces and particularly to a chess type game which provides play potential for three players.

2. Description of The Related Art

The conventional chess board of today provides a playing board surface for two players and consists of a square game board divided into sixty-four smaller squares of alternating, e.g., black and white, color. Two sets of play pieces, one being a first color, e.g, white, and one being a second color, e.g., black, are provided for movement on the game board according to conventional chess game rules.

I am not aware of any chess type board game which provides play potential for three individual players on the same game board.

SUMMARY OF THE INVENTION

Reflecting the popularity of chess, the present invention provides a chess type game which provides play potential for three players. The game incorporates an equilateral triangular shaped playing board with each side thereof having adjacent home areas from which the game pieces start play. Conventional chess pieces are utilized with the exception being that there are three sets of playing pieces. A red set, a white set and a blue set, or other three set collection of playing pieces wherein the respective sets are of differing colors, are used in place of the usual black and white sets play pieces. The game board of the invention in a preferred embodiment provides a playing surface composed of 64 smaller equilateral triangles with each side of the triangular game board having twelve rectangular (e.g., square) "home area" spaces.

In such preferred embodiment of the invention, each player has twelve game pieces of a particular color, i.e., six pawns, two rooks, two bishops, one queen and one king. The game of the present invention preferably does not use knight pieces as does the conventional game of chess. The game pieces begin play from their own "home area". The object is to win by checkmating one's opponents, or by reaching one's respective pinnacle with the king.

DETAILED DESCRIPTION OF THE PRESENT INVENTION, AND PREFERRED EMBODIMENTS THEREOF

Figure 1:
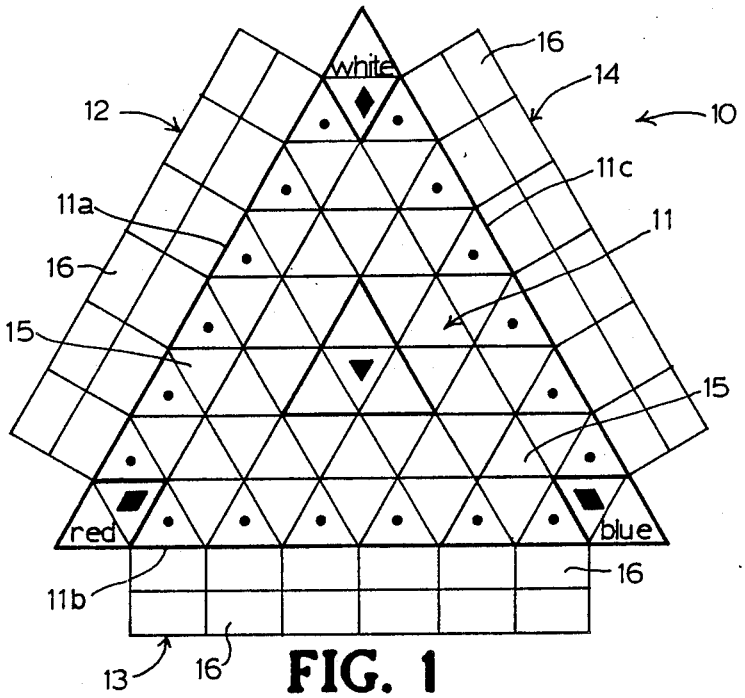
FIG. 1 is a plan view of the preferred embodiment of the game board.

As shown in FIG. 1, a game board 10 is provided having a generally flat top playing surface 11 in the shape of an equilateral triangle. The triangular playing surface 11 is divided into sixty-four smaller equilateral triangle playing spaces 15. Each side of the equilateral triangle has formed as an integral extension thereof a "home area". Side 11*a* has an associated "home area" 12, side 11*b* has an associated "home area" 13, and side 11*c* has an associated "home area" 14.

Each "home area" is divided into two rectangular rows with six rectangular game piece spaces 16 in each row. Triangular playing surface 11 and "home area" 12, 13, 14 together form the overall playing surface of the game board 10.

Figure 2:
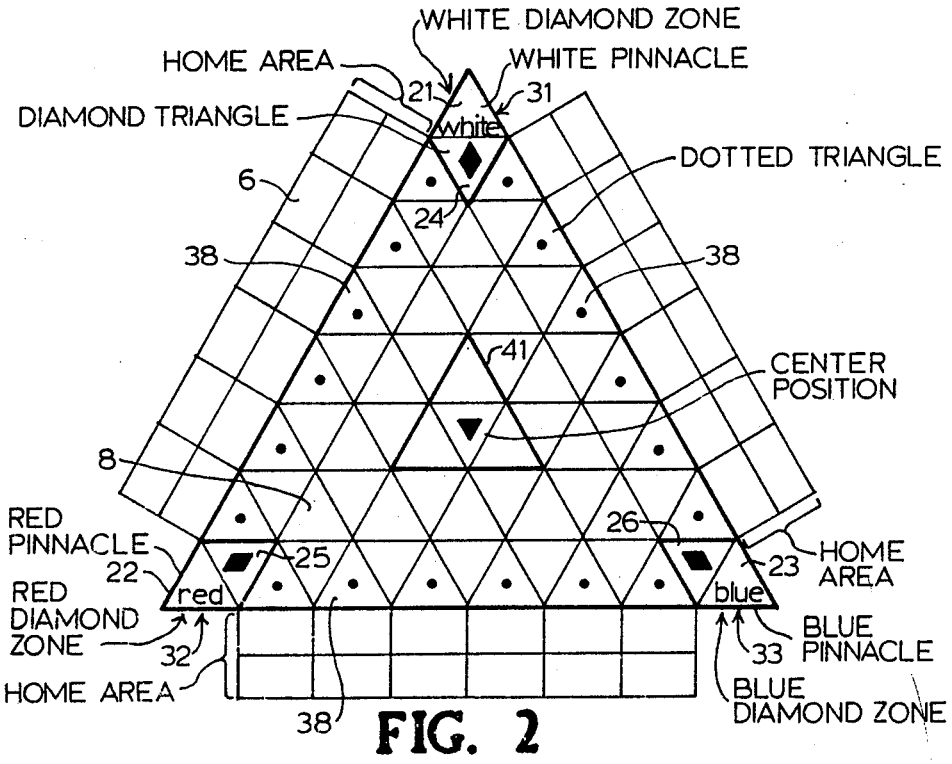
FIG. 2 is a plan view of the game board of FIG. 1 with the board areas labeled for a clearer understanding thereof.

Referring now specifically to FIG. 2 for a description and explanation of the various game board playing surface markings, triangles 21, 22, 23 are respectively labeled white, red and blue and are referred to as "pinnacles" of their respective colors. The pinnacles are equilateral triangle-shaped playing spaces which are located at each of the apices of the equilateral triangle-shaped playing surface. Each of these apex playing spaces has one side within the interior of the equilateral triangle-shaped playing surface and two sides along the edge of the equilateral triangle-shaped playing surface. The home area playing surface at each side of the equilateral triangle-shaped playing surface extends from one end of an interior side of an apex playing space to one end of an interior side of another apex playing space. "Diamond triangles" 24, 25, 26, are situated adjacent triangles 21, 22, 23. Together, pinnacle triangle 21 and diamond triangle 24 form "diamond zone" 31. Pinnacle triangle 22 and diamond triangle 25 together form diamond zone 32. Pinnacle triangle 23 and diamond triangle 26 together form diamond zone 33. Dotted triangles 38, as marked on the playing surface "side edge" triangles of the game board 10, are located adjacent the respective "home areas" 12, 13 and 14. Further, at the center of the game board 10 is provided an equilateral triangle 41 known as the "center position," which is a strategic location on the game board.

Figure 3:
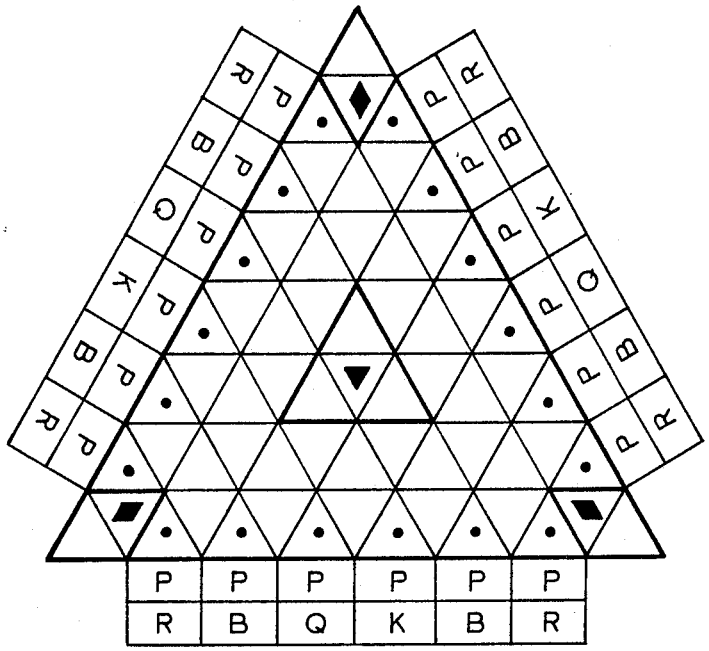
FIG. 3 is a plan view of the game board of FIG. 1 with the game pieces labeled by and illustrated in their starting positions in their "home areas".
Figure 4:
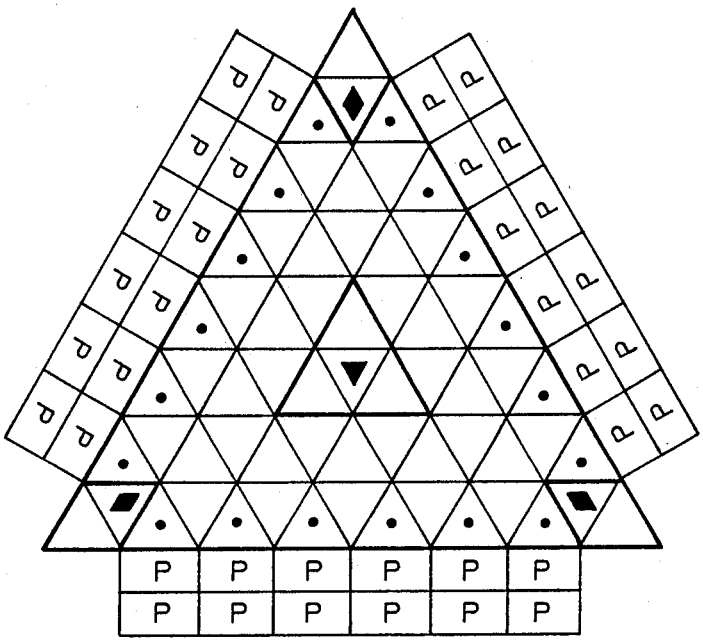
FIG. 4 is a plan view of an alternative game form wherein only pawns are used with each player having twelve pawns positioned in starting position in their "home areas".

Each player has twelve game pieces. While not illustrated in FIGS. 1 and 2, each player has six pawns (P), two rooks (R), two bishops (B), one queen (Q), and one king (K). Unlike conventional chess, the game of the present invention preferably does not employ any knight game pieces. For game set-up, at the initation of play, each player's game pieces are positioned in their respective home area positions, illustrated in FIG. 3. Each player begins play from their own home area, with the game objective being to win by checkmating one's opponents, or by reaching one's own respective pinnacle, opposite one's own home area, with one's king piece.

The following description in Table I will set forth the game pieces, moves, and applicable rules of the basic game according to one embodiment of the present invention.

TABLE I

| Basic Vortress TM Game | |
|---|---|
| The Pawn | |
| 1. | There are six pawns per player. |

TABLE I-continued

| Basic Vortress TM Game | |
|---|---|
| 2. | The pawn moves one space in any direction. |
| 3. | The pawn captures in the direction of the vertices of the game board. |
| 4. | The pawn cannot capture in the direction of the sides (bases) of the triangular game board, but can move in such direction if a space in such direction is unoccupied. |
| 5. | Pawns can move backwards at any time on their player's turn. |
| 6. | If a pawn progresses to its associated color pinnacle, it can be exchanged for a captured piece. THE POSSESSION OF TWO QUEENS IS NOT PERMITED, HOWEVER. Possession of "extra" game pieces is not permitted, either. |
| 7. | When the pawn has entered its home area, it captures on the diagonal, as in conventional chess. It may move in any direction while in its home area. |
| 8. | The pawn may enter the diamond zone, capture from the diamond triangle, but it may not access a home area from the diamond zone. |
| 9. | (See diagram below) There is no access by a pawn to a home area from a nondotted triangle. |

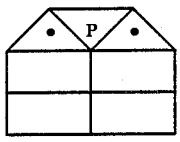

The Rooks

1. The rook may move any number of triangles in a straight line.
2. A rook cannot enter a home area unless on a dotted triangle. (See diagram 1 below).
3. If the rook is denoted R and the king is denoted K, the king in the position illustrated would be in check. (See diagram 2 below)
4. When the rook is in a home area, it moves as in conventional chess, but must enter a dotted triangle, counting as one move, when leaving. The same is true of entering.
5. The rook may enter the diamond zone.

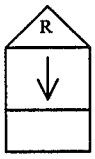

(1)

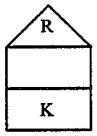

(2)

The Bishop

1. Bishops can move in straight line diagonals any number of triangles.
2. Bishops can enter a home area from any diagonal.

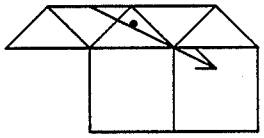

(1) yes

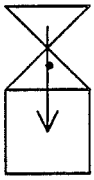

(2) No

3. Referring by way of example to FIG. 2, if the bishop were on triangle 8 and the king were on triangle 6, the bishop would be putting the king in check.
4. The bishop may enter the diamond zone.

The Queen

1. The queen is the most feared piece. It can move like any other piece.
2. The queen cannot enter a home area via a diamond zone.
3. The queen must enter a home area through a dotted triangle.

TABLE I-continued

| Basic Vortress TM Game | |
|---|---|
| 4. | The queen must be on a dotted triangle first in order to enter a home area, as would a rook. |
| 5. | The queen cannot castle. |
| The King | |
| 1. | The king may move in any direction one space at a time. |
| 2. | If the king reaches its color pinnacle, the king's player wins automatically. |
| 3. | The king may not enter the pinnacle if it will put its player in check. |
| 4. | The king may castle but not when in check. (See diagrams 1 or 2 below). The home area back row must be clear on the side the king wishes to castle. |

(1)

| | | | | | |
|---|---|---|---|---|---|
| | | | | | |
| | K | R | | | |

castle Queen side (2)

| | | | | | |
|---|---|---|---|---|---|
| | | | | | |
| | | | | R | K |

castle King side

| | |
|---|---|
| 5. | The king may not castle if he has moved or if the rook on either side has moved. |
| 6. | The king may enter any home area, but not by the diamond zone. |
| 7. | The king must be in a dotted triangle to enter home areas. |

The game board and playing pieces of the board game of the present invention may also be employed to play a number of variations of the basic game described above.

These game variations are described in Table II below with reference to the additional rules applicable thereto.

TABLE II

| Variation Games |
|---|
| 1. KING DIAMOND ENTRY - The king can enter another home area through the diamond zone. |
| 2. EXTRA PIECE RULE - If a pawn reaches the pinnacle, the corresponding player may get any opposing piece desired. |
| 3. NO PINNACLE RULE - No significance is accorded to the pinnacle position. |
| 4. TWO PLAYER VARIATION - The two players respectively take turns moving the third team. |
| 5. NO QUEEN CENTER - The queen may not enter the center position. |

In an alternative game, denominated "PAWNCHIZE," six extra pawns per player are employed instead of the two rooks, two bishops, queen and king used in the embodiments of Tables I and II, and play is conducted according to the rules set out in Table III below.

TABLE III

| PAWNCHIZE Rules |
|---|
| 1. The pawn can move in any direction one space at a time. |
| 2. The pawn captures other pawns through the vertex of a triangle, not through the base. |
| 3. A pawn may enter the home area, but not through the diamond zone. |
| 4. If a pawn is in the home area, it moves one space in any direction and captures on the diagonal. |
| 5. A pawn may not enter the home area from a triangle that does not have a dot. |
| 6. If a pawn reaches its color pinnacle, it becomes "kinged". |
| 7. A kinged pawn may move one space in any direction and capture in any direction. A kinged pawn may also enter home areas through the diamond zone. |
| 8. When a pawn is "kinged," it may be turned upside down. This game variation may employ pawn game pieces which are visually distinguishable between normal upright and inverted positions. Alternatively, the pawn game pieces may be retained in a normal upright position upon being "kinged" and may be "crowned" with a complementarily configured crown piece matable with the pawn game pieces. As yet another alternative, the pawn game pieces may be retired upon being kinged and may be replaced with a "king pawn" game piece, or the pawn game pieces may be provided with other structure or features indicative of the "kinged" or "unkinged" status of the such game pieces. |
| The object of the "PAWNCHIZE" game variation is to be the player having the last pawn remaining on the game board. |

The above description of the preferred and alternative embodiments of this invention is intended to be illustrative only and not in any way limiting as regards the scope and utility of the present invention. Other embodiments of this invention will be readily apparent to those skilled in the art in view of the above disclosure.

What is claimed is:

1. A three player chess game, comprising:

(a) a game board including:

(i) an equilateral triangle-shaped playing surface with an array of equilateral triangle-shaped playing spaces demarcated thereon, wherein there is an equilateral triangle-shaped apex playing space located at each of the three apices of the equilateral triangle-shaped playing surface, each of said apex playing spaces having one side located within the interior of the equilateral triangle-shaped playing surface and two sides along the edge of the equilateral triangle-shaped playing surface; and (ii) a rectangular home area playing surface at each side of the equilateral triangle-shaped playing surface, each of said home areas extending from one end of an interior side of an apex playing space to one end of an interior side of another apex playing space, to define respective home areas for the players' game pieces so that each of the three players has a separate home area at a specific side of the equilateral triangle-shaped playing surface, each of said home area playing surfaces having an array of spaces demarcated thereon defining home spaces for a specific player's game pieces; and (b) a set of game pieces for each of the three players each of the sets of game pieces being differentiable from the other sets so that all game pieces of a given set are identifiable as belonging to a specific player.

2. A three player chess game according to claim 1, wherein each said set of game pieces includes pawn, bishop, rook, queen and king game pieces.

3. A three player chess game according to claim 1, wherein said home area playing surface is of rectangular shape, and said home spaces are demarcated on each said home area playing surface in a 6×2 array of rectangular home spaces.

4. A three player chess game according to claim 1, wherein the equilateral triangle-shaped playing space at each apex of the equilateral triangle-shaped playing surface forms a constituent, together with an adjacent equilateral triangle-shaped playing space, of a demarcated diamond-shaped zone at each said apex of the equilateral triangle-shaped playing surface.

5. A three player chess game according to claim 1, wherein the equilateral triangle-shaped playing surface has centrally demarcated thereon a triangular center position zone formed of a plurality of constituent equilateral triangle-shaped playing spaces.

6. A three player chess game according to claim 1, wherein the equilateral triangle-shaped playing spaces having sides extending along the sides of the equilateral triangle-shaped playing surface, are adjacent to home area playing spaces which are coextensive in length with the corresponding sides of the equilateral triangle-shaped playing spaces respectively adjacent thereto.

7. A three player chess game according to claim 1, wherein the respective apices of the equilateral triangle-shaped playing surface comprise apex equilateral triangle-shaped playing spaces in which each apex equilateral triangle playing space is visually differentiated from the other apex equilateral triangle-playing spaces.

8. A three player chess game according to claim 7, wherein each of said apex equilateral triangle-shaped playing spaces is of a different, contrasting color to the others.

9. A three player chess game according to claim 1, wherein each said set of game pieces comprises only pawns.

10. A three player chess game according to claim 9, further comprising a set of instructions including the rules of Table III herein.

11. A three player chess game according to claim 1, further comprising a set of insructions including the rules of play of Table I herein.

12. A three player chess game according to claim 1, further comprising a set of instructions including the rules of play of Table II herein.

13. A three player chess game, comprising:

(a) a game board including:

(ii) an equilateral triangle-shaped playing surface with an array of equilateral triangle-shaped playing spaces demarcated thereon, including identifying indicia on selected ones of said equilateral triangle-shaped playing spaces comprising dots centrally disposed on peripheral equilateral triangle-shaped playing spaces along each side of the equilateral triangle-shaped playing surface, exclusive of the equilateral triangle-shaped playing spaces at the apices of the equilateral triangle-shaped playing surface; and (ii) a home area playing surface at each side of the equilateral triangle-shaped playing surface, to define respective home areas for the player's game pieces so that each of the three players has a separate home area at a specific side of the equilateral triangle-shaped playing surface, each of said home area playing surfaces having an array of spaces demarcated thereon defining home spaces for a specific player's game pieces; and (b) a set game pieces for each of the three players, each of the sets of game pieces being differentiable from the other sets so that all game pieces of given set are indentifiable as belonging to a specific player.

14. A three-player chess game, comprising:

(a) a game board including:

(ii) an equilateral triangle-shaped playing surface with an array of equilateral triangle-shaped playing spaces demarcated thereon, wherein said equilateral triangle-shaped playing surface has an array of 64 equilateral triangle-shaped playing spaces demarcated thereon, and (ii) a home area playing surface at each side of the equilateral triangle-shaped playing surface, to define respective home areas for the player's game pieces so that each of the three players has a separate home area at a specific side of the equilateral triangle-shaped playing surface, each of said home area playing surfaces having an array spaces demarcated thereon defining home spaces for a specific player's game pieces, wherein each of said home area playing surfaces has twelve rectangular-shaped home spaces demarcated thereon; and (b) a set of game pieces for each of the three players, each of the sets of game pieces being differentiable from the other sets so that all game pieces of given set are identifiable as belonging to a specific player.

* * * * *